United States Patent [19]

Daussan et al.

[11] 4,222,505

[45] Sep. 16, 1980

[54] ACTUATING DEVICE FOR A CASTING TUBE OR NOZZLE

[75] Inventors: Jean-Charles Daussan; Gérard Daussan, both of Metz; André Daussan, Longeville les Metz, all of France

[73] Assignee: Daussan et Compagnie, Woippy, France

[21] Appl. No.: 962,029

[22] Filed: Nov. 15, 1978

[30] Foreign Application Priority Data

Nov. 29, 1977 [FR] France ..... 77 35874

[51] Int. Cl.[2] ..... B22D 41/08

[52] U.S. Cl. ..... 222/600; 222/607; 164/437

[58] Field of Search ..... 164/82, 337, 437; 222/590, 591, 607, 600, 531, 533, 536, 537

[56] References Cited

U.S. PATENT DOCUMENTS

| | | | |
|---|---|---|---|
| 3,460,725 | 8/1969 | Golde . | |
| 3,743,007 | 7/1973 | Simons et al. | 222/560 X |
| 3,861,571 | 1/1975 | Franklin | 222/547 X |
| 3,884,400 | 5/1975 | Tuschak et al. | 222/607 |
| 4,091,861 | 5/1978 | Thalmann et al. | 222/607 X |
| 4,131,220 | 12/1978 | Bode, Jr. et al. | 222/607 |

FOREIGN PATENT DOCUMENTS

| | | | |
|---|---|---|---|
| 874886 | 7/1971 | Canada | 222/607 |
| 1493389 | 8/1967 | France . | |
| 22746 | of 1915 | United Kingdom . | |

*Primary Examiner*—David A. Scherbel
*Attorney, Agent, or Firm*—Young & Thompson

[57] ABSTRACT

A casting tube or nozzle is placed beneath the casting outlet of an upper vessel such as a casting ladle and immersed in the molten metal which is teemed into a lower vessel such as a casting tundish or directly into ingot-molds. A mechanism is provided for displacing the casting tube in pivotal motion between a vertical position in which it is applied against the casting outlet and a horizontal position of withdrawal in which it can also be displaced in a horizontal plane by means of a translational displacement mechanism.

10 Claims, 15 Drawing Figures

FIG_4
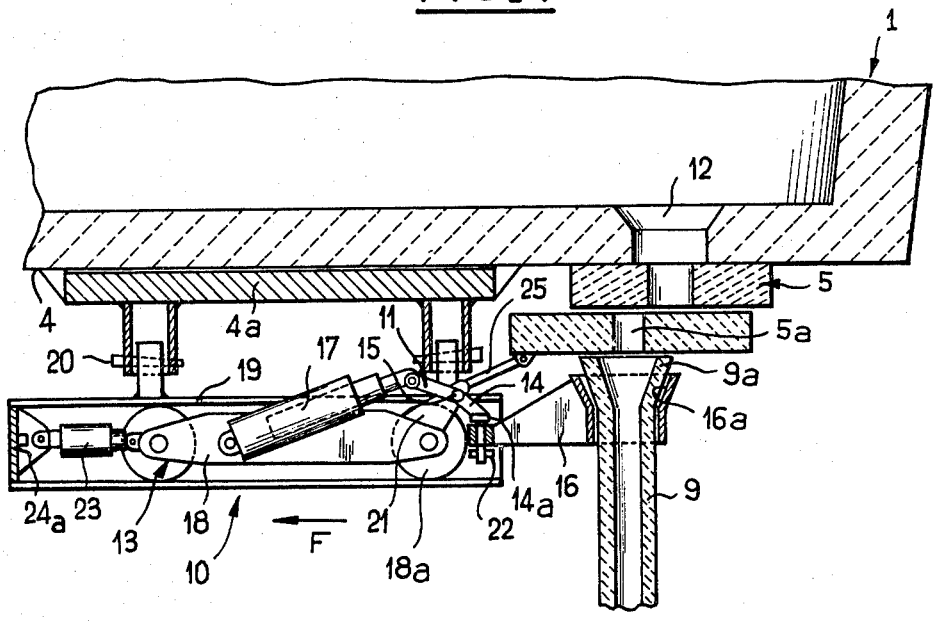
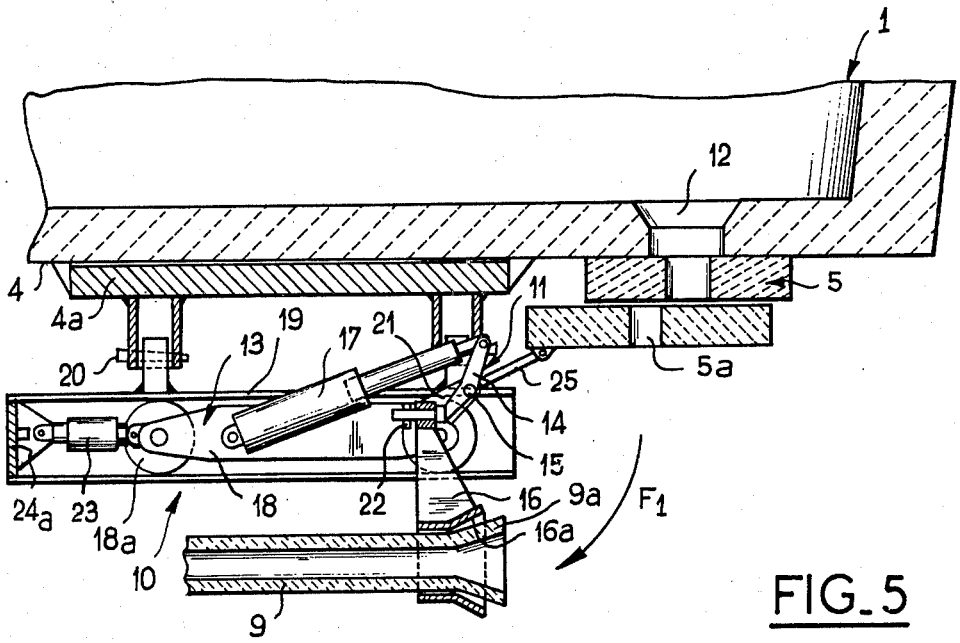
FIG_5

FIG_14
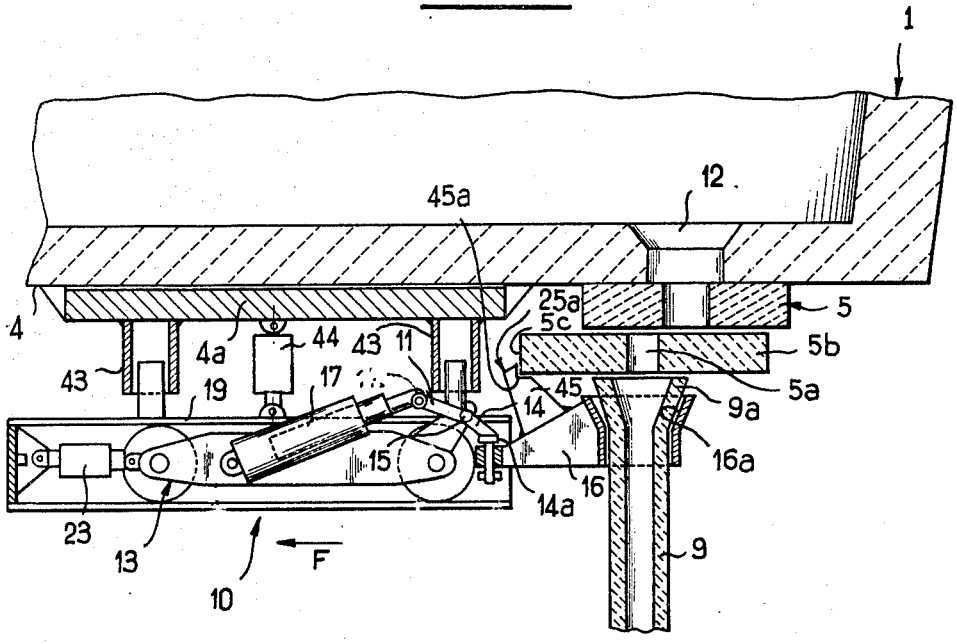
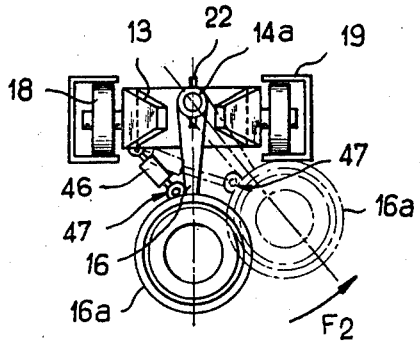
FIG_15

ACTUATING DEVICE FOR A CASTING TUBE OR NOZZLE

The present invention relates to an actuating device for a casting tube or casting nozzle, said device being intended to be placed beneath the casting outlet of a vessel such as a casting ladle containing molten metal.

Said casting tube or nozzle is in turn intended to be immersed in the molten metal contained in a second vessel such as a casting tundish which is placed beneath the first vessel.

It is already a known practice to make use of casting tubes or funnels placed beneath the casting outlet of a casting ladle and immersed in the molten metal which is poured either into a casting tundish or into ingot-molds. These casting tubes are usually of sheet steel, of fireproofed board, of refractory material such as fused silica or of graphite compressed in vacuum. The primary function of said casting tubes is to prevent projections or splashing caused by the jet of liquid metal. The disadvantage attached to the use of casting tubes of sheet steel lies in the need to carry out preheating over a long period in order to prevent cooling of the jet of molten metal as it passes through the tubes and in order to degas these latter with a view to preventing pollution of the metal.

Tubes of refractory material are costly to produce, heavy to transport and fragile.

Furthermore, casting tubes or funnels of fireproofed board have low strength and retain moisture which it is impossible to eliminate completely by heating.

Another known type of casting tube comprises a metallic structural framework to which is attached a heat-insulating lining having a base of refractory inorganic particles embedded in an organic or inorganic binder. A casting tube of this type represents a considerable improvement over known designs in that it is inexpensive to produce, has high strength, is easy to handle, provides effective heat insulation with respect to the molten metal which flows within the tube and does not entail any need for preliminary preheating.

However, a casting tube of this type and also of the types which were already known in the prior art have a major disadvantage in that they mask the jet of liquid metal at the time of casting. It is consequently impossible to observe and control the jet of molten metal in order to detect any impurities such as slag which may be present, especially at the end of the casting operation.

Since it is impossible to remove the casting tube prior to completion of the casting operation, there is consequently a risk of introducing into the lower vessel impurities which would be liable to affect the quality of the metal. Moreover, in the event of choking of the casting tube, teeming has to be stopped in order to remove the tube, with the result that the casting operation is disturbed to a considerable extent.

The aim of the invention is to overcome the disadvantages attached to known casting tubes by producing a device for displacing casting tubes or casting nozzles which are intended to be immersed in the liquid metal contained in a casting vessel.

In accordance with the invention, the device under consideration essentially comprises a mechanism for displacing the casting tube or nozzle in pivotal motion between a substantially horizontal position of withdrawal from the casting outlet of the first vessel and a vertical position in which said casting tube or nozzle is placed beneath the casting outlet and conversely, and a translational displacement mechanism for displacing the casting tube or nozzle in a substantially horizontal plane.

By means of this mechanism for controlling the displacement of the casting tube or nozzle, it is possible to withdraw this latter from the casting outlet of the first vessel without any need to stop the casting operation. It is thus possible at any moment to observe the teeming of molten metal in order to detect the appearance of slag or other impurities, especially at the end of the casting operation.

In an advantageous embodiment of the invention, the mechanism for displacing the tube in pivotal motion comprises an articulated lever provided at one end with a bracket for supporting the tube or the casting nozzle which is adapted to engage within an annular bearing surface of said bracket, the other end of said lever being connected to an actuating unit for displacing said lever in pivotal motion about its articulation. Said annular bearing surface of the support bracket serves to maintain the upper end of the tube while facilitating positioning and removal of the tube from the mechanism when said tube is in the horizontal position.

In a preferred embodiment of the invention, the translational displacement mechanism comprises a carriage which is capable of moving between two positions, said carriage being adapted to carry the articulated lever aforesaid and the support bracket which maintains the casting tube or nozzle. When the casting outlet of the first vessel is provided with closure means consisting of a slide-valve nozzle, the translational displacement mechanism is preferably connected to the slide-valve nozzle in order to carry out translational displacement of the casting tube as well as opening or closing of said slide-valve nozzle at the same time. Thus the casting tube is brought automatically into position beneath the casting outlet of the nozzle by opening this latter and the casting tube is withdrawn at the same time by closing said nozzle.

The above-mentioned mechanisms for producing pivotal and translational motion are advantageously controlled by hydraulic or pneumatic jacks or by means of toothed racks which cooperate with pinions.

Further distinctive features and advantages of the invention will become apparent from the following description, reference being made to the accompanying drawings which are given by way of example and not in any sense by way of limitation, and in which:

FIG. 4 is a view which is similar to FIG. 2 and shows the operation of the translational displacement mechanism of the device in accordance with the invention;

FIG. 5 is a view which is similar to FIG. 4 and shows the operation of the pivotal motion mechanism of the device in accordance with the invention;

FIG. 14 is a view which is similar to FIG. 4 and relates to another alternative embodiment of the device in accordance with the invention;

FIG. 15 is a view of the device according to FIG. 5, this view being taken along the axis of displacement of the carriage and some components having been removed for the sake of enhanced clarity.

Figure 1:
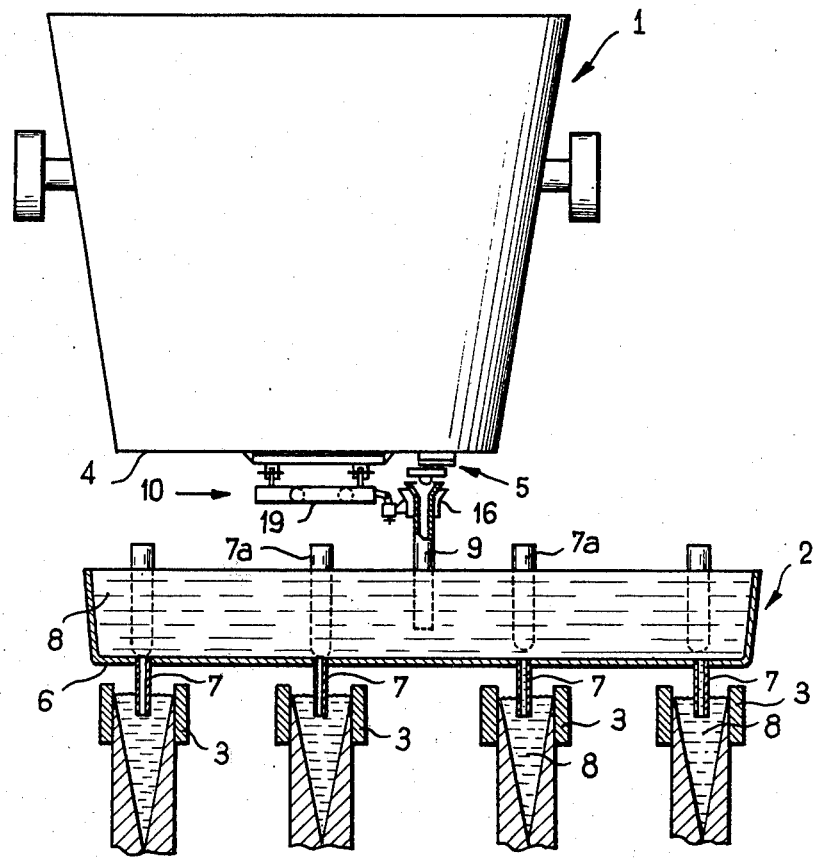
FIG. 1 is a view in elevation of a device in accordance with the invention which is placed between a casting ladle and a casting tundish for continuous pouring into a plurality of ingot-molds.

There is shown in FIG. 1 a casting ladle 1 placed above a casting distributor 2 which is in turn placed above four ingot-molds 3.

The bottom wall 4 of the casting ladle 1 is provided with a casting outlet (not shown in the figure) having an external extension in the form of a slide-valve nozzle 5 comprising a device which is known per se for opening and closing the casting outlet.

The bottom wall 6 of the casting tundish 2 is provided with casting nozzles 7, the lower portions of which are intended to dip into the molten metal 8 which is teemed into the ingot-molds 3. Teeming of the metal through said nozzles 7 can be interrupted by means of stopper rods 7*a*.

A casting tube 9 is placed between the slide-valve nozzle 5 of the casting ladle 1 and the casting tundish 2. Said casting tube is intended to surround the jet of molten metal which passes from the casting ladle 1 into the casting tundish 2.

Said casting tube 9, the lower portion of which is intended to be immersed in the liquid metal 8 contained in the tundish 2, is fabricated, for example, from refractory inorganic particles embedded in an organic or inorganic binder in order to provide heat insulation of the tube by means of a lightweight and economical material.

Said casting tube 9 prevents any cooling and oxidizing of the metal jet, thus also preventing the formation of alumina in the case of aluminum-killed steel and spattering of molten metal which presents a hazard for personnel working in the immediate vicinity of the casting installation.

In accordance with the invention, the casting ladle 1 is provided with an actuating device 10 comprising means for controlling the displacement of the tube 9 between a position of withdrawal from the casting outlet and a position in which said tube 9 is placed beneath said outlet so as to receive the jet of liquid metal derived from the casting ladle 1.

Figure 2:
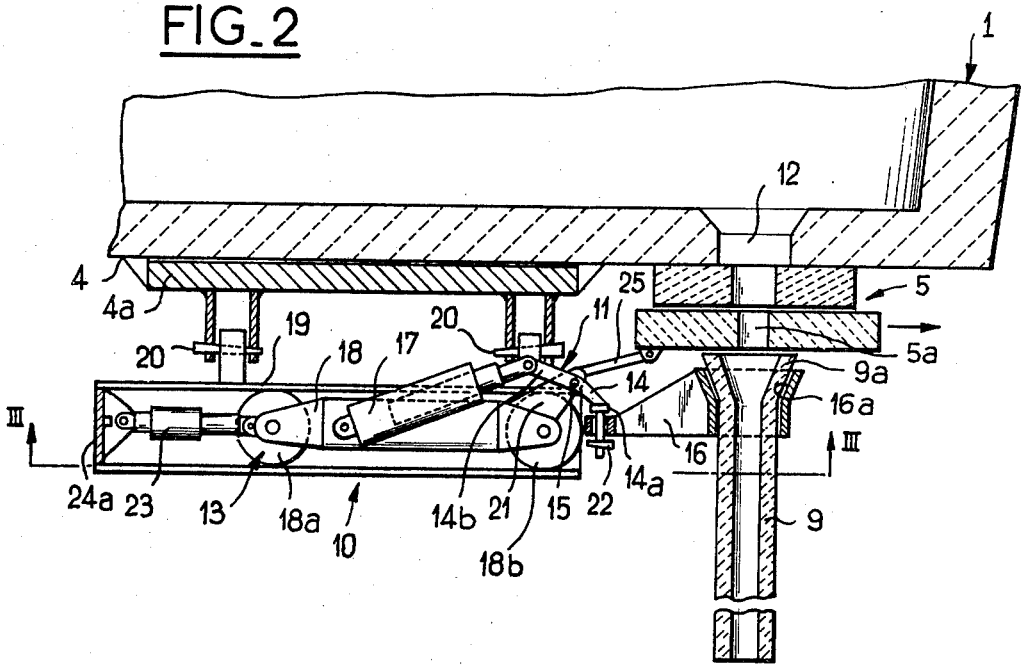
FIG. 2 is a longitudinal sectional view to a larger scale and showing the bottom portion of a casting ladle to which a device in accordance with the invention is attached.

In the embodiment of FIGS. 2 to 5, the control means aforesaid comprise a mechanism 11 for displacing the tube 9 in pivotal motion between a vertical position in which said tube 9 is placed beneath the casting outlet 12 of the casting ladle 1 (as shown in FIGS. 2 and 4) and a substantially horizontal position of withdrawal from the casting outlet 12 (as shown in FIG. 5).

In the example shown in FIGS. 2 to 5, the device 10 further comprises a translational displacement mechanism 13 for causing the tube 9 to move in a substantially horizontal plane between the positions indicated in FIGS. 2 and 4.

The pivotal displacement mechanism 11 comprises a lever 14 mounted on a pivot-pin 15. The extremity 14*a* of the lever 14 is adapted to carry a support bracket 16 which serves to maintain the tube 9. The other extremity 14*b* of the lever 14 is connected to a hydraulic or pneumatic jack 17.

The translational displacement mechanism 13 comprises a carriage 18 which is capable of moving along two rails 19. These two rails 19 are removably attached by means of locking-pins 20 to a metallic plate 4*a* which is in turn attached to the bottom wall 4 of the casting ladle 1. That end of the carriage 18 which is adjacent to the tube 9 has two arms 21 which carry the pivot-pin 15 of the lever 14.

It is further apparent from FIGS. 2, 4 and 5 that the support bracket 16 is removably attached to the extremity 14*a* of the lever 14 by means of a locking-pin 22.

Figure 3:
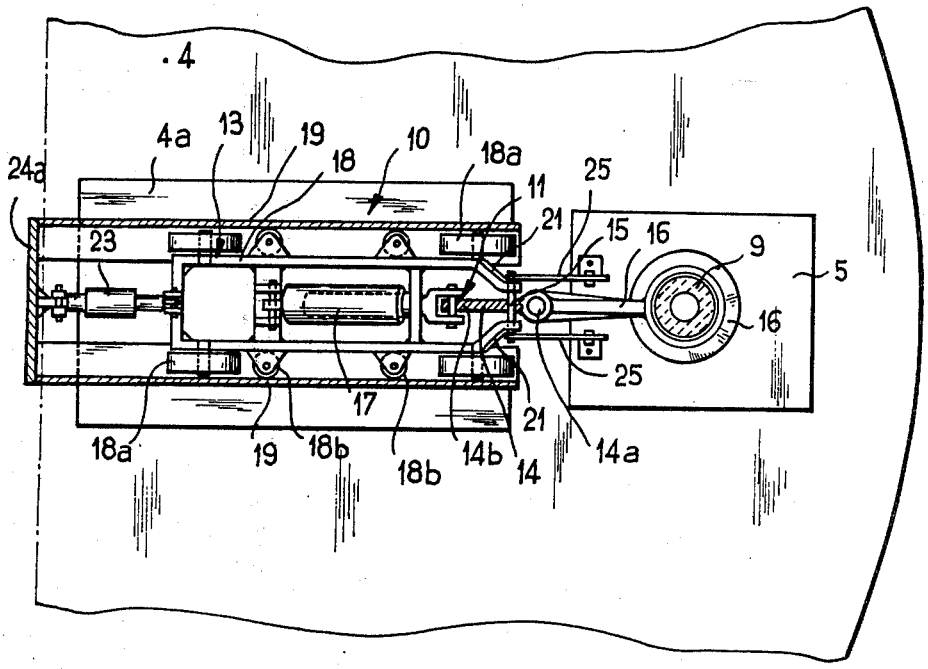
FIG. 3 is a sectional view taken along the plane III—III of FIG. 2.

In the example shown in FIGS. 2 to 5, the movement of the carriage 18 is controlled by a hydraulic or pneumatic jack 23 which is similar to the jack 17 for controlling the pivotal movement of the tube 9. The jack 23 is secured substantially in the axis of the carriage 18 against a stationary frame 24 (as shown in FIGS. 4 and 5) or to the plate 24*a* on the extremity of the rails 19 (as shown in FIGS. 2 and 3) whilst the jack 17 is secured to the carriage 18.

In the example shown in the drawings, the carriage 18 has four vertical wheels 18*a* and four horizontal wheels 18*b* for axial guiding of the displacement of the carriage 18.

It is also apparent from FIGS. 2 to 5 that the carriage 18 is coupled by means of rods 25 to the nozzle 5 of the slide-valve or rotating-cylinder type. In consequence, the translational displacement of the carriage 18 initiates opening or closing of the slide-valve nozzle 5 at the same time.

It will further be noted in the example which is illustrated that the casting tube 9 has a flared-out top portion 9*a* which is removably engaged within a corresponding annular bearing surface 16*a* of the support bracket 16 which is attached to the carriage 18.

The operation of the casting-tube actuating device 10 described in the foregoing is as follows:

At the time of casting, the slide-valve nozzle 5 is in the open position and its lower orifice 5*a* is located in the axis of the casting outlet 12. The casting tube 9 is also located in the axis of the orifices 12 and 5*a*.

During the casting operation, the tube 9 prevents cooling of the liquid metal jet which passes through this tube and also prevents spattering caused by impact of the jet on the bath of molten metal 8 (shown in FIG. 1) which is poured into the casting tundish 8.

At the end of the casting operation, the casting tube 9 is displaced by actuating the jack 23, which has the effect of displacing the carriage 18 in the direction of the arrow F (as shown in FIG. 4). In this position, the orifice 5*a* of the slide-valve nozzle 5 is displaced with respect to the casting outlet 12 of the ladle 1, with the result that teeming of the metal is stopped.

The tube 9 is then caused to carry out a pivotal movement in the direction of the arrow $F_1$ from the vertical position of FIG. 4 to the horizontal position of FIG. 5 by actuating the jack 17. In this position, the lower portion of the casting tube 9 is withdrawn from the molten metal bath 8 contained in the casting tundish 2 (see FIG. 1).

In this position, the casting ladle 1 can be transferred to the ladle filling station without being hindered by the presence of the casting tube 9.

Furthermore, the jet of molten metal can be observed from the casting position shown in FIGS. 2 and 3 in order to detect the presence of any impurities such as slag in the metal at the end of the casting operation. To this end, the jack 17 is actuated directly in such a manner as to displace the casting tube 9 in pivotal motion through an angle of 90° without closing the slide-valve nozzle 5 or in other words without displacing the carriage 18.

Pivotal motion of the casting tube 9 can also be initiated in the event of choking either of the casting tube or of the nozzle 5. Moreover, pivotal displacement to the horizontal position shown in FIG. 5 facilitates removal of the tube 9 for subsequent replacement by a fresh casting tube. It should also be mentioned that, in the event of any incident of operation, the casting tube 9 can be separated from the actuating device 10 simply by removing the locking-pin 22 which secures the support bracket 16 to the lever 14 of the carriage 18.

The actuating device 10 in accordance with the invention consequently offers many advantages which are primarily intended to reduce all unnecessary delay in the event of casting incidents, to improve operational safety and to facilitate to a considerable extent both the positioning and removal of the casting tube 9 before, after or during the casting operation.

It is readily apparent that the invention is not limited to the example of construction described in the foregoing with reference to FIGS. 2 to 5 and that many modifications can be made in this form of construction without thereby departing either from the scope or the spirit of the invention.

Figure 6:
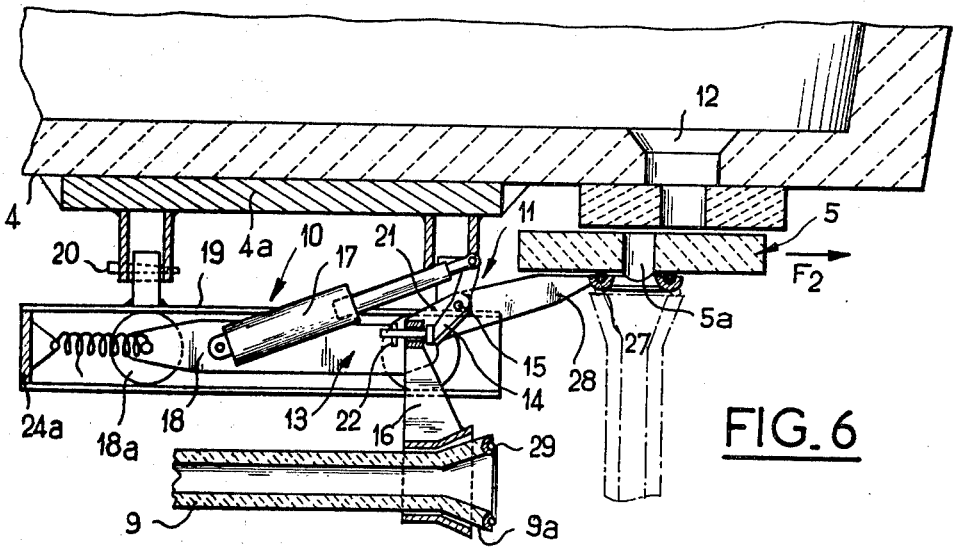
FIG. 6 is a view which is similar to FIG. 5 and shows an alternative embodiment of the device in accordance with the invention.

Thus it follows that, in the embodiment of FIG. 6, the movement of the carriage 18 is no longer controlled by a hydraulic or pneumatic jack but is controlled instead by the device (not shown in the drawings) for closing and opening the slide-valve nozzle 5. In the example which is illustrated, the slide-valve nozzle is in the closed position. By actuating the device for opening the nozzle 5, said nozzle is displaced in the direction of the arrow $F_2$, thus displacing the carriage 18. At the time of opening of the nozzle 5, the carriage 18 is returned automatically to its initial position by means of a spring 26 which is attached to the opposite end of the carriage 18 with respect to the nozzle 5.

In the example of FIG. 6, it is proposed in addition to insert a seal 27 of putty or asbestos, for example, between the tube 9 and the slide-valve nozzle 5. Said seal 27 is carried by a relatively flexible arm 28 which is intended to be interposed between the flared-out end portion 9*a* of the tube 9 and the nozzle 5.

When the tube 9 is in the horizontal position as shown in FIG. 6, the seal 27 is held lightly in contact with the adjacent surface of the nozzle 5. On the other hand, when the tube 9 is displaced to the vertical position (as shown in chain-dotted lines), the flared-out end portion 9*a* of said tube is applied beneath the extremity of the arm 28 which supports the seal 27 and compresses this latter against the nozzle 5 under a thrust which is preferably within the range of approximately 80 to 100 kg. Excellent leak-tightness is thus obtained between the casting tube 9 and the nozzle 5.

By virtue of the high standard of leak-tightness thus achieved, different gases such as argon, for example, can be blown into the tube 9 in order to prevent oxidation of the liquid metal which passes through the tube 9.

Leak-tightness of this order can also be obtained by placing a seal 29 on the end portion 9*a* of the casting tube 9.

Figure 7:
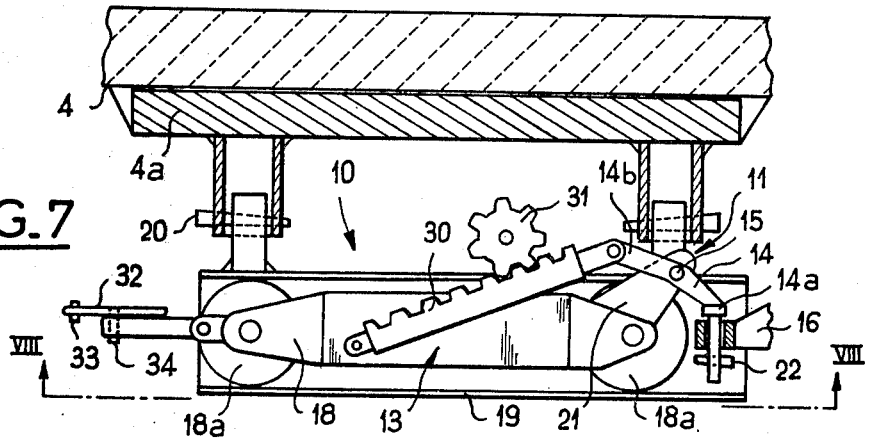
FIG. 7 is a longitudinal part-sectional view showing another alternative embodiment of the device in accordance with the invention.
Figure 8:
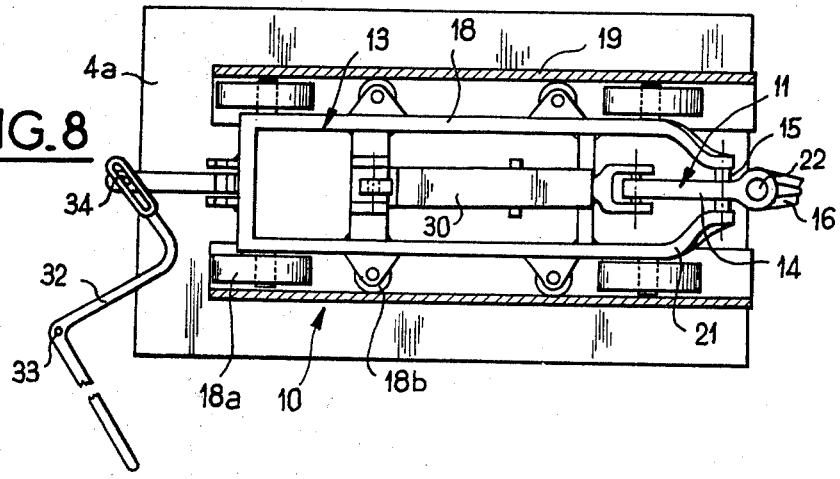
FIG. 8 is a transverse sectional view taken along the plane VIII—VIII of FIG. 7.

In the embodiment of FIGS. 7 and 8, the jack 17 which controls the pivotal displacement of the casting tube 9 of the device shown in FIG. 2 is replaced by a toothed rack 30 which cooperates with a pinion 31. In addition, the jack 23 which controls the translational displacement of the carriage 18 is replaced by a lever 32 which is pivotally mounted at 33 and 34.

Figure 9:
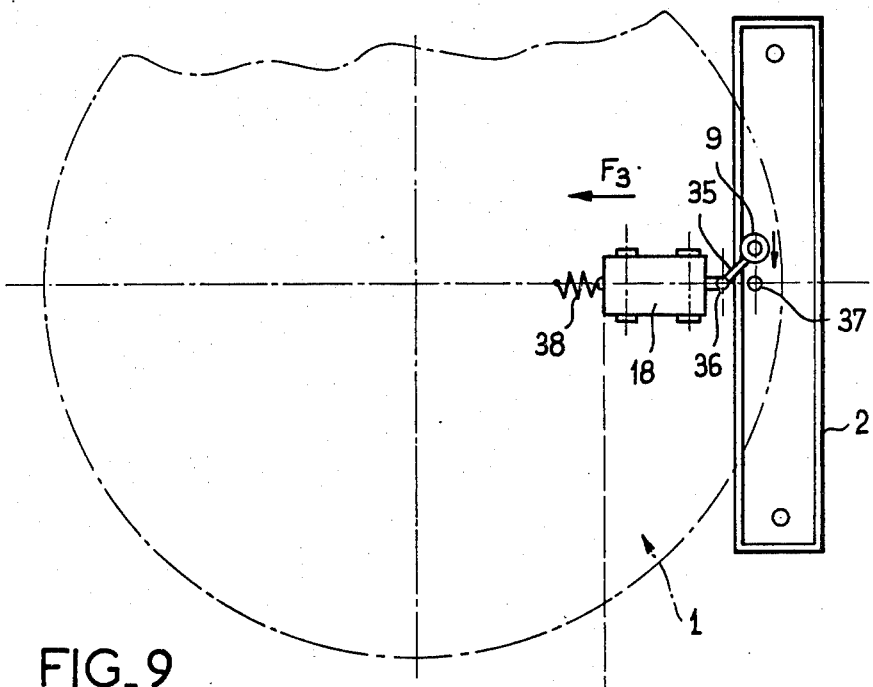
FIGS. 9 and 10 are two diagrammatic bottom views of a third alternative embodiment of the device in accordance with the invention in two different positions of operation.
Figure 10:
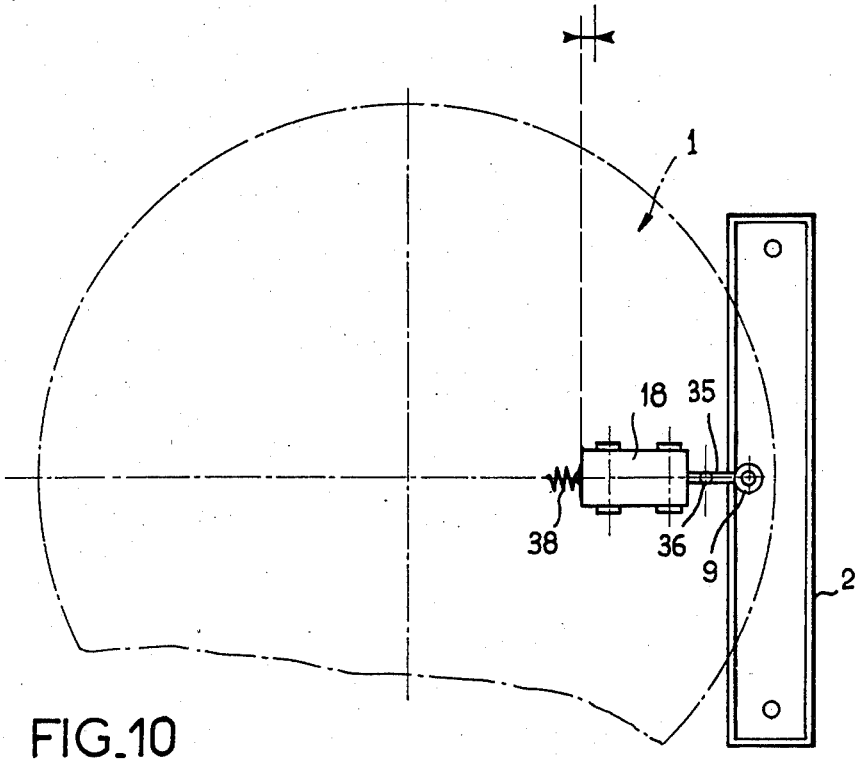

In the embodiment shown in FIGS. 9 and 10, the support bracket 35 of the casting tube 9 is pivotally connected to the carriage 18 at 36. The direction of displacement of said carriage can thus be perpendicular to the direction of displacement of the casting tube 9 instead of being parallel as in the case of the previous embodiments.

In the case of FIG. 9, the tube 9 is relatively displaced with respect to the casting outlet 37 of the casting ladle 1 and the support bracket 35 makes a predetermined angle with the axis of the carriage 18. By displacing the carriage 18 in the direction of the arrow $F_3$ under the action of the restoring spring 38, the bracket 35 is aligned along the axis of the carriage (see FIG. 10) and the tube 9 is placed beneath the casting orifice 37. The embodiment of FIGS. 9 and 10 is of interest when it is not possible to fix the device in accordance with the invention in the direction of opening or closing of a slide-valve nozzle.

Figure 12:
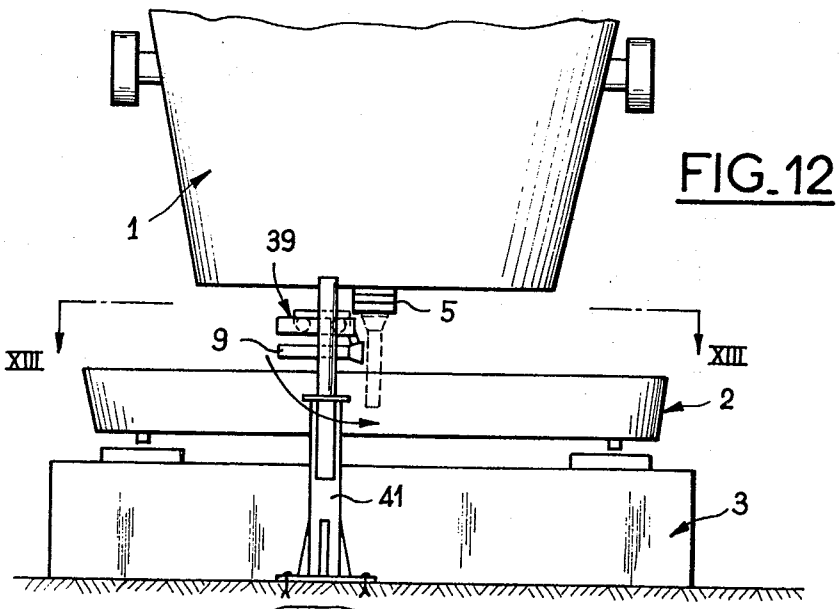
FIG. 12 is a view taken at right angles to the view of FIG. 11.
Figure 13:
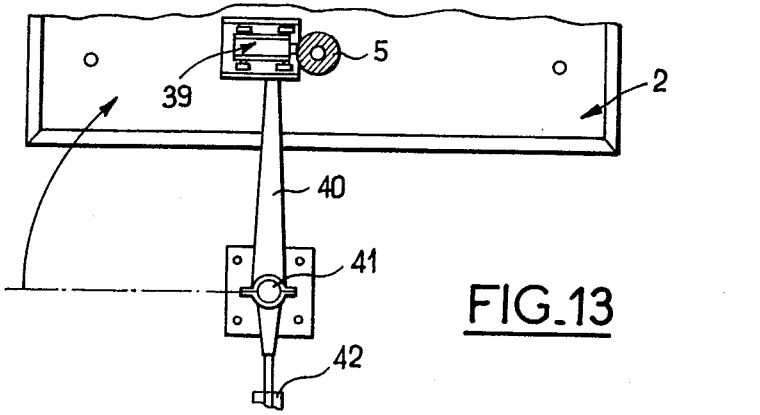
FIG. 13 is a view taken along the plane XIII—XIII of FIG. 12.
Figure 11:
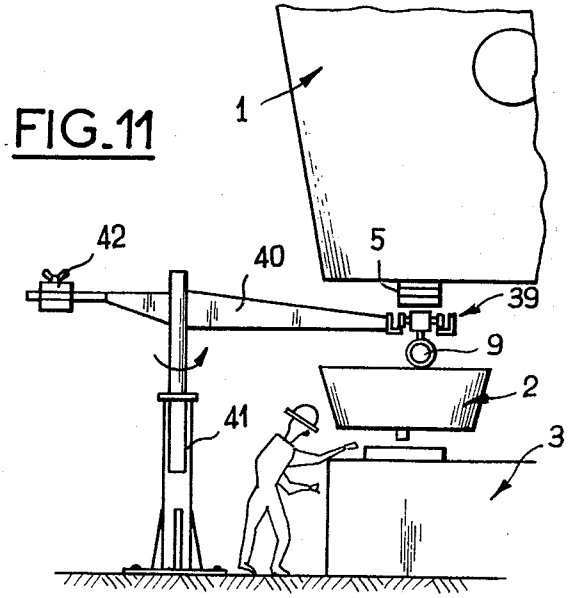
FIG. 11 is a view in elevation showing a casting installation comprising a device in accordance with the invention which is mounted on a supporting pillar.

In the embodiment of FIGS. 11 to 13, the actuating device 39 of the casting tube 9 is no longer attached to the bottom wall of the casting ladle 1 but is carried by an arm 40 which is pivotally mounted on a supporting pillar 41. The weight of the actuating device 39 is balanced by a counter-weight 42.

This device has the advantage of being independent of the casting ladle 1, with the result that the different ancillary control elements of the actuating device such as the pipes (not shown) connected to the different hydraulic or pneumatic jacks do not need to be disconnected prior to displacement of the casting ladle 1.

Moreover, the fact that the arm 40 is capable of pivotal motion makes it possible to displace the actuating device 39 in such a manner as to adapt this latter to the different casting outlets of a given casting vessel or of a number of casting vessels placed side by side.

The supporting pillar 41 can also be movably mounted on rails.

Moreover, the device in accordance with the invention can also be employed for actuating nozzles to such as the nozzles 7 of the casting tundish shown in FIG. 1. Among other advantages, the device in accordance with the invention makes it possible in an application of this type to carry out rapid replacement of a choked or defective nozzle.

In the embodiment shown in FIG. 14, the carriage 13 is secured to the plate 4*a* of the bottom wall of the casting ladle 1 by means of telescopic guides 43. Between said plate 4*a* and the carriage 13 is also placed a hydraulic jack 44 or the like for adjusting the distance between the carriage 13 and the bottom wall 4 of the casting ladle 1. The end portion 16*a* of the tube 9 can thus be brought into intimate contact with the casting outlet 5*a* of the nozzle 5.

Furthermore, the support bracket 16 of the tube 9 carries a lug 45 which comes into contact with the lower portion 5*b* of the slide-valve nozzle 5. The distance between said lug 45 and the axis of the tube 9 (in the vertical position) is equal to the distance between the axis of the opening 5*a* and the surface 5*c* of the lower portion 5*b* of the nozzle 5, namely the surface which comes into contact with the lug 45. Said lug 45 thus makes it possible to ensure very accurate positioning of the tube 9 with respect to the opening 5*a* of the nozzle 5. Furthermore, the extremity of the lug 45 is provided with a rightangled recess 45*a* which is adapted to fit over the bottom edge of the nozzle 5*b*. This accordingly prevents any lateral displacement of the support bracket 16 with respect to the direction of displacement of the carriage 13.

In the embodiment shown in FIG. 15, the support bracket 16 of the casting tube 9 is mounted on the pin 14*a* for pivotal displacement about an axis which is parallel to the tube 9. Moreover, said support bracket 16 is connected to a jack 46 or the like for displacing said support bracket 16 in pivotal motion towards the carriage 13 (as shown by the arrow $F_2$) about the pivot-pin 14*a* when the tube 9 is in the horizontal position. Said jack 46 is attached to the carriage 13 and to the support bracket 16 by means of swivel-joint couplings 47. This arrangement makes it possible to reduce the overall height of the device in accordance with the invention in order to allow greater clearance within the space formed between the casting ladle 1 and the casting tundish which is placed beneath this latter. The jack 46 mentioned above can be replaced by any other drive system, for example of the chain and pulley type.

We claim:

1. An actuating device for a casting tube or casting nozzle, said device being intended to be placed close to the bottom of a vessel containing molten metal, beneath the casting outlet of said vessel, and said casting tube or nozzle being intended to be immersed in the molten metal contained in a second vessel placed beneath the first vessel, wherein said device comprises a mechanism for displacing the casting tube or nozzle in pivotal motion back and forth between a vertical position in which said casting tube or nozzle is placed beneath the casting outlet and a substantially horizontal position in which said casting tube or nozzle is away from the casting outlet of the first vessel, said mechanism comprising an articulated lever, said lever having an articulation, said lever supporting removably at one end thereof the casting tube or nozzle, the other end of said lever being connected to an actuating device for displacing said lever in pivotal motion about its articulation, the actuating device further comprising a translational displacement mechansim for displacing said casting tube or nozzle in a substantially horizontal plane, said translational displacement mechanism carrying said articulated lever.

2. A device according to claim 1 in which the translational displacement mechanism comprises a carriage which is capable of moving between two positions, wherein said carriage is adapted to carry the articulated lever aforesaid and a support bracket mounted at said one end of the articulated lever to maintain the casting tube or nozzle.

3. A device according to claim 2, wherein the support bracket is articulated with respect to the lever of the translational displacement mechanism, the direction of displacement of said mechanism being perpendicular to the direction of displacement of the casting tube or nozzle.

4. A device according to claim 2, wherein the carriage is attached to the bottom wall of the casting vessel by means for adjusting the distance between said carriage and said bottom wall of the casting vessel.

5. A device according to claim 2, wherein the support bracket of the casting tube is pivoted with respect to the articulated lever about an axis which is substantially parallel to the tube, said support bracket being connected to a jack for causing pivotal displacement of said bracket towards the carriage about the pivotal axis aforesaid when the tube is in the horizontal position.

6. A device according to claim 1 in which the casting outlet of the first vessel is provided with closure means constituted by a nozzle of the slide-valve type, wherein the translational displacement mechanism is connected to the slide-valve nozzle in order to carry out translational displacement of the casting tube as well as opening or closing of said slide-valve nozzle at the same time.

7. A device according to claim 6, in which a support bracket is mounted at said one end of the articulated lever to maintain the casting tube or nozzle, wherein said support bracket of the casting tube carries a lug which is intended to come into contact with the lower portion of the slide-valve nozzle, the distance between said lug and the axis of the tube being equal to the distance between the axis of the opening formed in the lower portion of the slide-valve nozzle and the contact surface between said lower portion and said lug.

8. A device according to claim 1, wherein the movement of the translational displacement mechanism is controlled by a toothed rack in cooperating relation with a pinion.

9. A device according to claim 1, in which the casting outlet of the first vessel is provided with closure means constituted by a nozzle of the slide-valve type, wherein the translational displacement mechanism is actuated in one direction by the unit which serves to control the opening or closing of the slide-valve nozzle and in the other direction by a restoring spring which is attached to said translational displacement mechanism.

10. A device according to claim 1, wherein the translational displacement mechanism is provided with a relatively flexible arm which carries a seal, said seal being intended to be interposed between the casting tube or nozzle and the casting outlet of the first vessel.

* * * * *